United States Patent [19]

Morris

[11] 4,103,797

[45] Aug. 1, 1978

[54] TIGHTLY CLOSED SAFETY CAP AND VIAL

[76] Inventor: Glenn H. Morris, 4203 Highwood Dr., Chattanooga, Tenn. 37415

[21] Appl. No.: 767,288

[22] Filed: Feb. 10, 1977

Related U.S. Application Data

[63] Continuation-in-part of Ser. No. 690,962, May 28, 1976, Pat. No. 4,036,385.

[51] Int. Cl.[2] ..... B65D 55/02; B65D 85/56; A61J 1/00

[52] U.S. Cl. ..... 215/209; 215/211; 215/214; 215/217

[58] Field of Search ..... 215/209, 211, 214, 216, 215/221, 217, 329, 356

[56] References Cited

U.S. PATENT DOCUMENTS

| | | | |
|---|---|---|---|
| 3,089,603 | 5/1963 | Smith | 215/329 X |
| 3,110,411 | 11/1963 | Golde | 215/329 |

*Primary Examiner*—George T. Hall
*Attorney, Agent, or Firm*—Brady, O'Boyle & Gates

[57] ABSTRACT

A container or vial for medicines has a reversible internally and externally screw-threaded closure for selective engagement with internal and external screw-threads on the mouth of the container. Wedge sealing rings on the reversible closure force the coacting screw-threads of the closure and container into tight compressive engagement in either position of use of the closure so that the container is tightly closed. A group of locking teeth on the skirt of the closure cooperate with a single laterally movable tooth adjacent to the container side wall to lock the closure on the container so that it cannot be separated from the container without complex manipulation, thereby rendering the device child-proof. The movable tooth of the container is supported in spaced relation from the container side wall by a yielding bar carried by two radial support arms joined to the container.

9 Claims, 8 Drawing Figures

FIG. 1
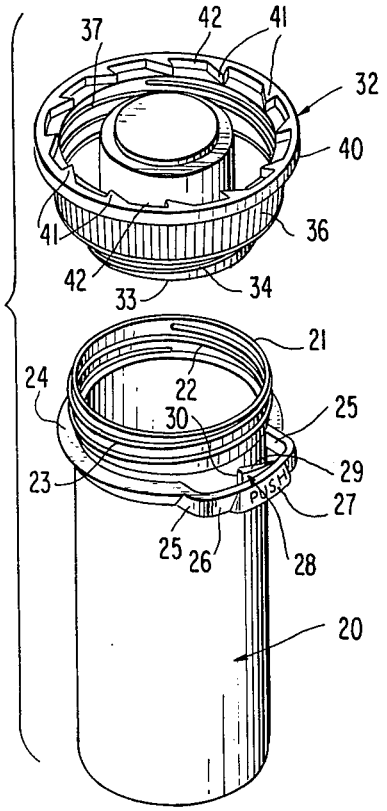
FIG. 2
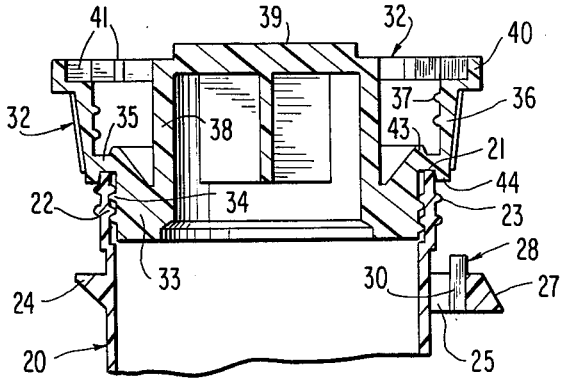
FIG. 3
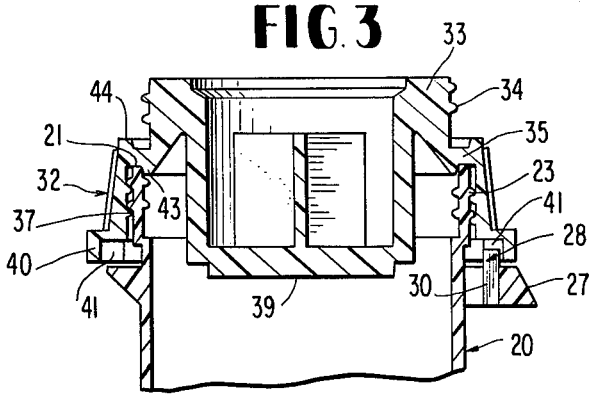
FIG. 5
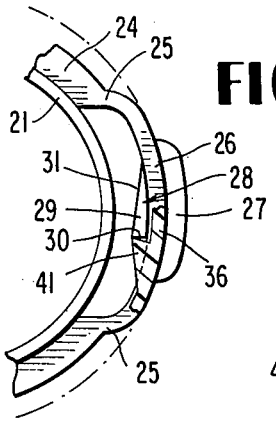
FIG. 4
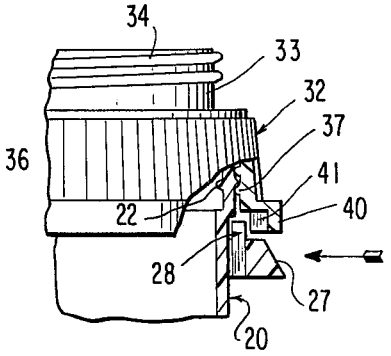
FIG. 7
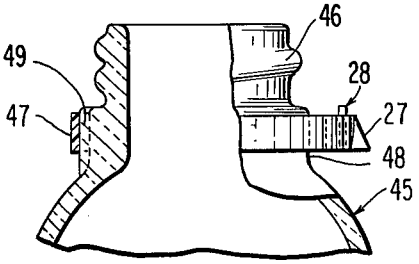
FIG. 8
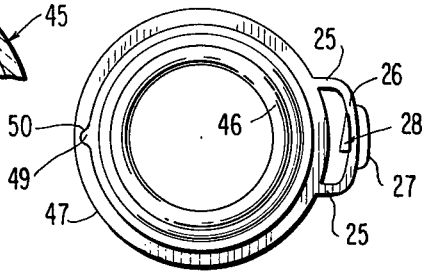
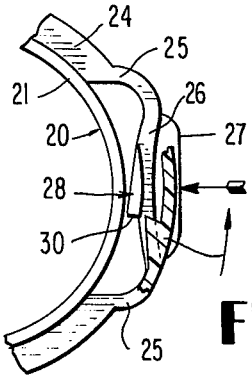
FIG. 6

TIGHTLY CLOSED SAFETY CAP AND VIAL

CROSS-REFERENCE TO RELATED APPLICATION

This application is a continuation-in-part of prior copending application Ser. No. 690,962, filed May 28, 1976, for SAFETY CLOSURE FOR CONTAINERS, now U.S. Pat. No. 4,036,385.

BACKGROUND OF THE INVENTION

Quite a wide variety of safety containers and safety closures for medicine containers and vials are known in the prior art. In addition to the prior art United States patents noted in the above-referenced application, U.S. Pats. Nos. 3,902,620 and 3,989,152 are examples of relevant patented art.

One objective of the present invention is to further improve on the known prior art including the closure toothed locking means shown in the above-referenced application. In accordance with the present invention, a more durable and stable yielding carrier means for the single side mounted laterally movable locking tooth of the container body is provided for improved coaction with a group of widely spaced axially formed teeth on the interior of the skirt portion of the container closure.

Additionally, the present invention provides a unique sealing means on the reversible closure which enables the closure in both of its positions of use on the container to comply fully with the requirements of the classification of "Tightly Closed Containers" under the U.S. Pharmacopeia Standards to become effective in April of 1977. In terms of actual laboratory test results, the invention far exceeds the requirements of the new law relating to moisture permeability. For example, under the new standards, the required National Formulary Test Procedure states "The containers so tested are tight containers if not more than one of the 10 test containers exceeds 100 mg per day per liter in moisture permeability and none exceeds 200 mg per day per liter." The test containers embodying the present invention averaged 77 mg per day per liter with the highest single test vial showing 92 mg per day per liter of moisture permeability.

An important aspect of the invention resulting in the above superior test results is the provision on the reversible closure of a pair of oppositely facing wedge sealing rings which coact cammingly with the mouth of the container or vial in both positions of use of the closure to force the screw-threads of the closure into tight compressive engagement with the opposing threads of the container, and thus form a very positive and effective seal which more than meets the new standards for "Tightly Closed Containers".

Other features of novelty will be apparent during the course of the following description.

BRIEF DESCRIPTION OF DRAWING FIGURES

FIG. 1 is an exploded perspective view of a container and closure combination embodying the invention.

FIG. 2 is an enlarged fragmentary central vertical section through an assembled container and closure in one position of use of the reversible closure.

FIG. 3 is a similar cross sectional view showing the closure in its second position of use on the container and with the safety locking tooth of the container in the active locking position.

FIG. 4 is a fragmentary vertical section, similar to FIG. 3, showing the container locking tooth moved laterally inwardly to the closure releasing position.

FIG. 5 is a fragmentary plan view of the container and the single safety locking tooth thereof and associated tooth supporting means, portions of the closure being superimposed in cross section.

FIG. 6 is a view similar to FIG. 5 showing the container locking tooth displaced inwardly laterally to the closure release position.

FIG. 7 is a side elevation, partly in vertical section, showing a modified form of the invention adaptable to a glass container or vial.

FIG. 8 is a plan view of the invention shown in FIG. 7.

DETAILED DESCRIPTION

Referring to the drawings in detail wherein like numerals designate like parts, a medicine container 20 of cylindrical form is illustrated and is preferably molded from a commercial plastics material designated Amber PRO-fax® 6331N. Equivalent moldable materials having the required resistance to moisture permeability may be employed. The molded container 20 while quite rigid has some degree of flexibility under hand pressure.

The container 20 has its mouth defined by a straight edge 21 normal to the axis of the container. The mouth of the container has molded internal and external screw-threads 22 and 23. An external annular shoulder 24 is formed on the container 20 somewhat below the screw-threads 23, and at one side wall region, FIG. 1, the shoulder 24 is interrupted and a pair of short parallel generally radial support arms 25 are joined integrally to the shoulder 24 and project outwardly from the container side wall. These arms are joined by a circumferentially curved resilient bar 26 spaced from the cylindrical side wall of the container 20 and preferably having a push lug 27, or enlargement, formed thereon. A single radially narrow and circumferentially wide locking tooth 28 is formed integrally with the bar 26 at the center region thereof. This tooth has a top vertically inclined face 29 which projects above the top of the bar 26, a vertical end face 30 projecting from the interior side of the bar 26, and a horizontally inclined inner face 31. The bottom of the tooth 28 is flush with the bottom of the bar 26.

As illustrated in FIGS. 3 through 6, when thumb pressure is applied to the push lug 27 in the radial direction relative to container 20, the resilient bar 26 will yield and bow inwardly, FIG. 6, and the tooth 28 will be displaced laterally or radially inwardly toward the cylindrical side wall of the container 20.

A molded cap or closure 32, preferably formed of the same material specified for the container 20, is provided and the closure is reversible end-for-end with two positions of use on the container, as illustrated in FIGS. 2 and 3. In the position shown in FIG. 2, the reversible closure is not child-proof or safe and the locking tooth 28 is not operational. In this mode, the closure 32 merely plugs the container mouth but does have the capability of forming a "Tightly Closed Container" under the new U.S. Pharmacopeia Standards, as will be fully described. In the second or alternate position of use, FIG. 3, the closure 32 constitutes a child-proof safety cap for the medicine container 20 wherein the displaceable tooth 28 of the container cooperates lockingly with a group of teeth on the closure 32, to be described.

More particularly, the closure 32 has a central plug body 33 having external screw-threads 34 for engagement with the internal threads 22 of the container. The plug body 33 is joined by an annular web 35 to a skirt portion 36 which has internal screw-threads 37 adapted to engage the external threads 23 of the container, FIG. 3. A central cylindrical sleeve portion 38 of the closure 32 rising from the plug body 33 extends through the skirt portion 36 in spaced concentric relation therewith and terminates in an end wall 39 which may bear suitable molded instructional indicia, such as "Not Safe From Child," meaning that the closure 32 is not childproof and not securely locked when used in the plug mode of FIG. 2.

A further enlarged short skirt extension 40 of the threaded closure 32 projects beyond the internally threaded portion 36 and is provided on its interior with a group of widely circumferentially spaced axially formed tapered locking teeth 41. These teeth 41 ratchet into interlocking engagement with the single container tooth 28 as the closure 32 is gradually screwed down onto the container 20 in the safety cap mode of use shown in FIG. 3. When the closure is completely applied to the container, the tooth 28 will be received lockingly in one wide space 42, FIG. 1, between a pair of the teeth 41, so that the closure 32 cannot be released until the user first forces the tooth 28 laterally inwardly by thump pressure and clear of the teeth 41 as illustrated in FIGS. 4 and 6. At this time, the threaded closure 32 can be rotated in the proper direction to release it from the external screw-threads 23 of the container. However, it can be seen that a complex manipulation, not readily understood by children, is required to release the closure 32. When thumb pressure on the element 27 is removed, the bar 26 will return by memory to its normal position and shape shown in FIGS. 3 and 5. The provision of the two short support arms 25 for the yielding bar 26 form a stable and durable support means for the laterally displacable tooth 28, causing the latter to move in the desired direction under thumb pressure.

A salient feature of the invention is the provision on the reversible closure 32 of a pair of oppositely facing wedge sealing rings 43 and 44, both integrally formed with the annular web 35. The two wedge sealing rings are best shown in FIGS. 2 and 3 of the drawings. It may be noted in these figures that the interior side wall of the sealing ring 44 is conically tapered and converges upwardly in FIG. 2 toward the open mouth of the container 20. Thus, when the closure 32 is applied to the container as a plug, FIG. 2, the upper edge 21 is sealed against the bottom of web 35, which is the bottom of the unobstructing groove, and the conically tapered interior side of wedge ring 44 forces or wedges the upper edge laterally into the unobstructing groove and the internal threads 22 of the container laterally into tight compressive engagement with the threads 34 of the closure to form a very tight seal.

Likewise, when the closure 32 is employed in safety cap mode, FIG. 3, the other wedge sealing ring 43 whose outer side wall is conically tapered and converges into the mouth of the container 20 forces the upper edge laterally into the unobstructing groove and the screw-threads 23 of the container laterally into tight sealing engagement with the internal threads 37 of the closure to effect a seal. Simultaneously, the end surface 21 of the container is sealed against the web 35. Therefore, in each position of use of the closure 32, the unique wedge sealing rings 43 and 44 function to tighten the engagement of the container and closure screw-threads, and in this manner, the invention meets and exceeds the new standards for "Tightly Closed Containers".

Another feature may be noted with reference to FIGS. 3 and 5, namely, that when the closure 32 is fully applied to the container in safety cap mode so that the tooth 28 lies in one of the wide spaces 42 between closure teeth 41, rotational force on the closure in the direction to loosen it will only wedge the teeth 28 and 41 into tighter locking engagement, FIG. 5.

FIGS. 7 and 8 show an embodiment of the invention adaptable to a glass container or vial 45 having a threaded neck 46. In this embodiment, a plastic adapter ring or band 47 is shrunk onto a cylindrical wall portion 48 of the glass container by known techniques. A small key 49 on the container 45 interlocks with a notch 50 in the band 47 to prevent relative rotation of the parts. The previously-described locking tooth 28, resilient support bar 26 and arms 25 are integrally attached to the adapter ring 47. The closure 32 is not shown in FIGS. 7 and 8 but its mode of operation relative to the tooth 28 and associated parts is as described in the previous embodiment.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In a container, a container body having a mouth provided with internal and external screw-threads, a reversible closure for the container having an externally threaded plug body and an opposite end internally threaded skirt, the threads of the plug body being engageable with the internal screw-threads of the container mouth in one position of use of the closure and the threads of the skirt being engageable with the external screw-threads of the container mouth in a second position of use of the closure, and first and second oppositely facing wedge sealing rings on the closure, one wedge sealing ring engaging the exterior of the mouth of the container in said one position of use of the closure and forcing the internal screw-threads of said mouth into tight compressive engagement with the external threads of said plug body, and the other wedge sealing ring engaging within the container mouth in the second position of use of the closure and forcing the external screw-threads of said mouth into tight compressive engagement with the internal threads of said skirt.

2. In a container defined in claim 1, and said one wedge sealing ring having an interior side conically tapered face, said face tapering axially outwardly of the mouth of the container, the second wedge sealing ring having a conically tapered exterior side face, said face tapering axially inwardly relative to said mouth.

3. In a container defined in claim 2, and a transverse web on said reversible closure between and interconnecting said plug body and skirt, and said first and second oppositely facing wedge sealing rings carried by opposite sides of said transverse web.

4. In a container, a container body having a mouth and being provided with screw-threads near said mouth, a closure for the mouth of the container and being screw-threaded for threaded engagement with the screw-threads of said container, the closure having a skirt portion spaced from and surrounding the container side wall, a circumferential group of spaced axially formed teeth on the interior of said skirt portion and being spaced from the container side wall, a single coacting safety locking tooth for said closure, a deflectable support bar for said locking tooth carrying the locking tooth and being spaced with the locking tooth from the container side wall, said deflectable bar when in a normal relaxed position holding said locking tooth in substantial alignment with the teeth of said closure skirt portion, and a pair of end support arms for said deflectable bar joined to the container side wall and to said bar and projecting away from the container side wall to form with said bar a generally U-shaped support structure for said single safety locking tooth, said deflectable bar yielding under manual pressure applied radially of the container to displace said locking tooth laterally inwardly toward the container side wall and out of locking engagement with the teeth of the closure skirt portion.

5. In a container as defined in claim 4, and said deflectable support bar being elongated and extending approximately circumferentially of the container side wall and being resilient, said pair of end support arms being comparatively short and substantially rigid and generally parallel.

6. In a container as defined in claim 4, and said single safety locking tooth disposed near the longitudinal center of said defectable support bar and being on the interior side thereof and having a vertically inclined top face projecting above the deflectable support bar and having a substantially vertical end face immediately inwardly of the inner side of the support bar for interlocking engagement with generally radial faces of teeth on said closure skirt portion.

7. In a container as defined in claim 6, said single safety locking tooth on said deflectable support bar being elongated circumferentially of the container and closure and the axially formed teeth of the closure skirt portion being widely spaced for ratcheting engagement with the single locking tooth during threaded application of the closure to the container, the single locking tooth adapted to nest snugly between one pair of teeth on the closure skirt portion when the closure is fully applied to the container.

8. In a container as defined in claim 4, and a ring member separate from the container body and surrounding the container body and being fixed relative thereto and carrying said pair of end support arms.

9. In a container, a container body having a mouth of plastics material having some degree of flexibility and provided with screw-threads, a closure for the container having threads thereon engageable with the screw-threads of the container mouth, an unobstructing groove in said closure above said closure threads, a depending wedge sealing ring on the closure above the closure threads forming one side of the groove only at a position opposite the closure threads and engaging the mouth of the container when the closure is threadably tightened thereon, and said wedge sealing ring forcing the mouth of the container laterally into the unobstructing groove and the screw-threads of said mouth laterally into tight compressive engagement with the threads of said closure.

* * * * *